US006439223B1

(12) United States Patent
Draper et al.

(10) Patent No.: US 6,439,223 B1
(45) Date of Patent: Aug. 27, 2002

(54) LANTERN SYSTEM

(76) Inventors: Diana Clifton Draper, 9516 Lake Dr., New Port Richey, FL (US) 34654; George E. Draper, Jr., 9516 Lake Dr., New Port Richey, FL (US) 34654

( * ) Notice: Subject to any disclaimer, the term of this patent is extended or adjusted under 35 U.S.C. 154(b) by 0 days.

(21) Appl. No.: 09/492,821

(22) Filed: Jan. 27, 2000

(51) Int. Cl.[7] ..... F21V 33/00

(52) U.S. Cl. ..... 126/258; 126/48; 431/344; 362/93; 362/179; 362/180

(58) Field of Search ..... 126/47, 48, 256, 126/258, 260; 431/344; 362/93, 179, 180

(56) References Cited

U.S. PATENT DOCUMENTS 2,583,916 A * 1/1952 Wickman ..... 126/256
3,133,536 A * 5/1964 Knapp ..... 126/258
3,408,998 A * 11/1968 Brancato et al. ..... 126/47
4,572,157 A * 2/1986 Napier ..... 162/258
5,417,200 A * 5/1995 Wasielewski ..... 126/258
5,423,309 A * 6/1995 Miller, Sr. et al. ..... 126/260

* cited by examiner

*Primary Examiner*—Sara Clarke

(57) ABSTRACT

A lantern system capable of being selectively utilized as a source of light for illumination purposes and as a source of heat for cooking purposes, includes a lower assembly including a base constituting a closed container for the receipt of fuel. An upper assembly includes a chimney. A handle assembly includes a rigid U-shaped wire with small loops at its ends. A fluid delivery assembly includes a linear pipe secured with regard to the lower assembly and upper assembly with an inverted U-shaped tube secured with respect thereto and has an input end operatively associated with a mantle support within the chimney supporting a mantle to support combustion therein for illumination and heating. A dome assembly has an annular vertical wall with two notches positionable to straddle the bolts when used for illumination. A cooking assembly has legs extending downwardly with notches positionable to straddle the bolts.

5 Claims, 4 Drawing Sheets

LANTERN SYSTEM

BACKGROUND OF THE INVENTION

1. Field of the Invention

The present invention relates to a lantern system and more particularly pertains to utilizing common components for light and/or heat at the discretion of a user.

2. Description of the Prior Art

The use of lamps and heaters for use when camping of known designs and configurations is known in the prior art. More specifically, previously devised and utilized for the purpose of providing light and providing heat through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,773,458 to Spotts discloses a portable convertible mantle-lantern, camp stove. U.S. Pat. No. 3,804,075 to Rummel discloses attachments for lanterns. U.S. Pat. No. 4,029,079 to Elder discloses a lantern stove device attachment. U.S. Pat. No. 4,372,198 discloses a lantern hot plate. U.S. Pat. No. 4,091.795 discloses a cooking adapter. U.S. Pat. No. 4,954,075 discloses a lantern head for backpacker's stove. Lastly, U.S. Pat. No. 5,113,843 to Henry et al. discloses a combustion device for stoves and fireplaces.

While these devices fulfill their respective, particular objectives and requirements, the aforementioned patents do not describe lantern system that allows utilizing common components for light and/or heat at the discretion of a user.

In this respect, the lantern system according to the present invention substantially departs from the conventional concepts and designs of the prior art, and in doing so provides an apparatus primarily developed for the purpose of utilizing common components for light and/or heat at the discretion of a user.

Therefore, it can be appreciated that there exists a continuing need for a new and improved lantern system which can be used for utilizing common components for light and/or heat at the discretion of a user. In this regard, the present invention substantially fulfills this need.

SUMMARY OF THE INVENTION

In view of the foregoing disadvantages inherent in the known types of lamps and heaters for use when camping of known designs and configurations now present in the prior art, the present invention provides an improved lantern system capable of being selectively utilized as a source of light for illuminating purposes and as a source of heat for cooking purposes. As such, the general purpose of the present invention, which will be described subsequently in greater detail, is to provide a new and improved lantern system capable of being selectively utilized as a source of light for illuminating purposes and as a source of heat for cooking purposes and method which has all the advantages of the prior art and none of the disadvantages.

To attain this, the present invention essentially comprises a new and improved lantern system capable of being selectively utilized as a source of light for illumination purposes and as a source of heat for cooking purposes. First provided is a lower assembly. The lower assembly includes a base constituting a closed container for the receipt of fuel. The base is formed with a large circular plate at the bottom and a small circular region at the top and with a tapering side wall between the large circular plate and small circular region. The lower assembly also includes a first ring with a horizontal face with four vertical apertures. The lower assembly also includes a shaped intermediate component coupling the base and the lower ring. An upper assembly includes a chimney frame formed of a second ring at its upper extent. Four vertical apertures are provided in the second ring. A vertical wall is provided with diametrically opposed holes. The chimney frame also has four posts with lower ends secured in the apertures of the first ring and with upper ends secured in the apertures of the second ring. Two bolts each have a rectilinear head secured above the upper ends of two of the posts. The bolts have threaded ends extending through the holes of the vertical wall. The upper assembly also includes a cylindrical glass chimney supported on the horizontal face of the first ring and extending upwardly to the second ring radially interior of the posts. An intercasing assembly is provided. The intercasing assembly is removably secured to the upper surface of the second ring. A vertically extending wall is provided. The vertically extending wall has a lower end formed with two notches straddling the bolts radially interior of the second ring. A handle assembly is next provided. The handle assembly includes a rigid U-shaped wire with small loops at its ends and two nuts threadedly received in the radially exterior ends of the bolts. Each nut has a radially exterior end with a knurled gripping surface to allow rotation for coupling and uncoupling purposes. Each nut also has an annular recess for pivotally receiving a loop. Each nut also has an abutment shoulder on its radially interior face. A fluid delivery assembly is provided. The fluid delivery assembly includes a linear pipe secured with respect to the lower assembly and upper assembly. A lower end of the pipe is within the base. An upper end of the pipe is at the upper extent of the upper assembly. The delivery assembly also includes an inverted U-shaped tube secured with respect to the intercasing assembly. The U-shaped tube has an input end operatively associated with the upper end of the linear tube and an output end. A mantle support is provided within the chimney to support a mantle for supporting combustion therein for illumination and heating. Next provided is a control assembly. The control assembly includes (a) a valve within the lower assembly and an associated control knob extending outwardly from the intermediate component of the lower assembly to vary the rate of fuel fed from the tank to the mantle, (b) a preheater having a lower end extending into the tank and an upper end extending into the chimney and an central region for supporting a flame with an operator controlled switch pivotable between a lower position to extinguish a flame and an upper position to permit a flame, (c) a gauge having an interior end extending into the tank and an exterior end to display the pressure within the tank, and (d) pressure generating mechanisms coupleable to the tank through a threaded stub, adapted for use as an orifice for adding fuel to the tank. Such mechanisms include a valve with an exposed exterior end for coupling to an external source of pressure. The exterior end has a removable cap and, as an alternative pressure generating mechanism includes a finger pump with a leather washer within the tank at the lower end and a reciprocable pusher at the upper end. A rod between the finger pump and pusher effects reciprocation of the leather washer for increasing pressure within the tank. A coil spring around the rod urges the knob upwardly. Locking components are provided to selectively secure the pusher in a downward orientation. A dome assembly is provided. The dome assembly has an annular vertical wall with two notches positionable to straddle the bolts radially exterior of the second ring when used for illumination purposes. The dome assembly also has a cover and two intermediate vertical walls with openings for ventilation. Lastly, a cooking assembly is provided. The cooking assembly has an annular vertical wall. Ventilation openings are provided through the vertical wall. The vertical wall has an upper circular end formed with a circular horizontal shoulder. The vertical wall also has a lower end. The lower end has two diametrically opposed legs with inturned horizontal extensions positionable upon the intercasing assembly. The lower end also has two additional legs extending downwardly with notches positionable to straddle the bolts radially exterior of the second ring when used for cooking purposes. The cooking assembly also includes a circular plate with an exterior periphery positionable upon the circular horizontal shoulder. The circular plate also includes four pie shaped openings having cross-shaped support legs with small apertures at the ends of the support legs and rigid rods in a cross-shaped configuration overlying the support legs and with a down turned end secured within the small apertures.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved a lantern system capable of being selectively utilized as a source of light for illuminating purposes and as a source of heat for cooking purposes which has all of the advantages of the prior art lamps and heaters for use when camping of known designs and configurations and none of the disadvantages.

It is another object of the present invention to provide a new and improved lantern system capable of being selectively utilized as a source of light for illuminating purposes and as a source of heat for cooking purposes which may be easily and efficiently manufactured and marketed.

It is further object of the present invention to provide a new and improved lantern system capable of being selectively utilized as a source of light for illuminating purposes and as a source of heat for cooking purposes which is of durable and reliable constructions.

An even further object of the present invention is to provide a new and improved a lantern system capable of being selectively utilized as a source of light for illuminating purposes and as a source of heat for cooking purposes which is susceptible of a low cost of manufacture with regard to both materials and labor, and which accordingly is then susceptible of low prices of sale to the consuming public, thereby making such lantern system economically available to the buying public.

Even still another object of the present invention is to provide lantern system capable of being selectively utilized as a source of light for illuminating purposes and as a source of heat for cooking purposes at the discretion of a user.

Lastly, it is an object of the present invention to provide a new and improved lantern system capable of being selectively utilized as a source of light for illumination purposes and as a source of heat for cooking purposes. The system includes a lower assembly including a base constituting a closed container for the receipt of fuel. An upper assembly includes a chimney. A handle assembly includes a rigid U-shaped wire with small loops at its ends. A fluid delivery assembly includes a linear pipe secured with regard to the lower assembly and upper assembly with an inverted U-shaped tube secured with respect thereto and has an input end operatively associated with a mantle support within the chimney supporting a mantle to support combustion therein for illumination and heating. A dome assembly has an annular vertical wall with two notches positionable to straddle the bolts when used for illumination. A cooking assembly has legs extending downwardly with notches positionable to straddle the bolts.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
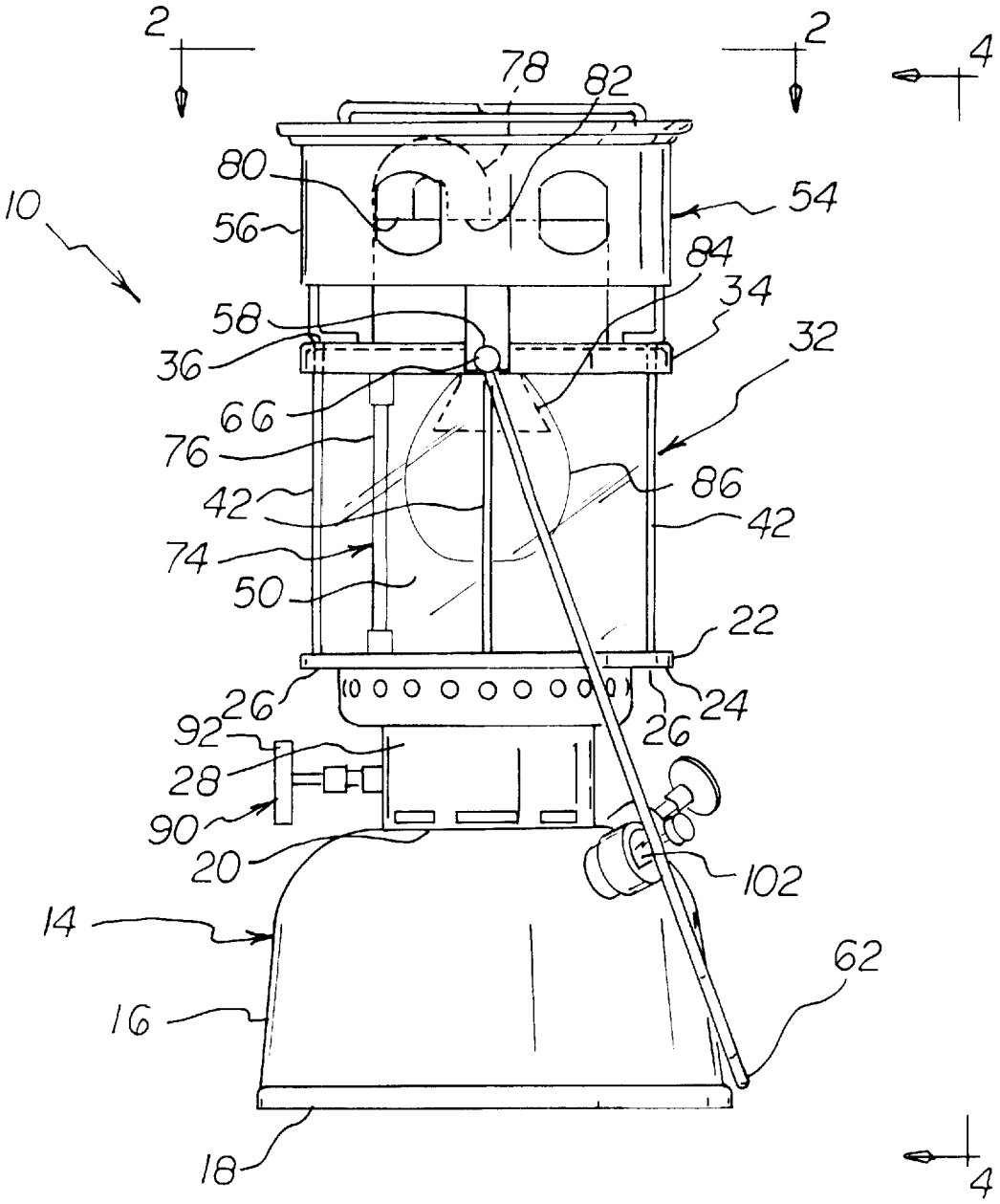
FIG. 1 is a side elevational view of the new and improved lantern system constructed in accordance with the principles of the present invention.
Figure 2:
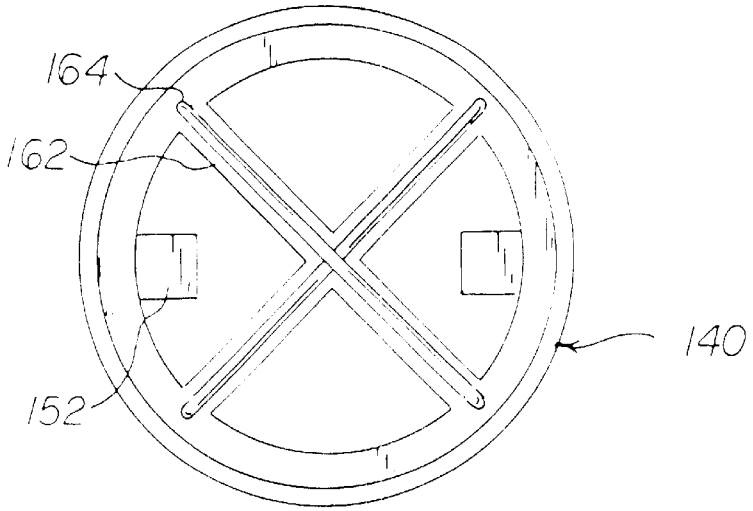
FIG. 2 is a top elevational view taken along line 2—2 of FIG. 1.
Figure 3:
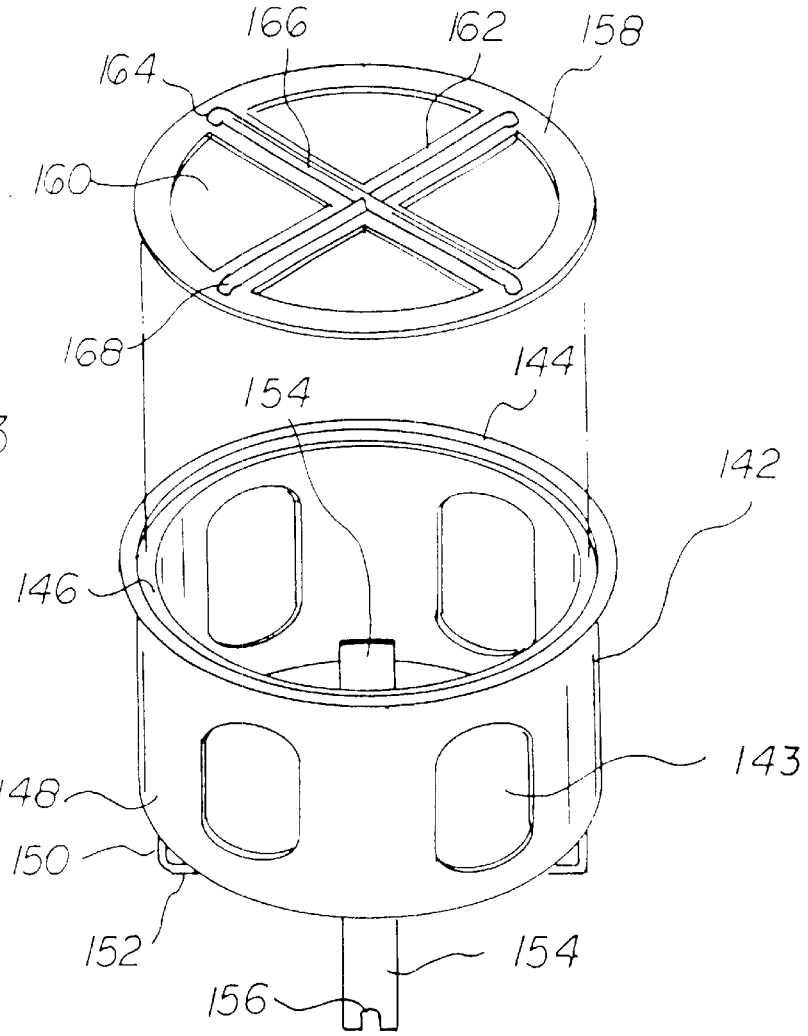
FIG. 3 is an exploded perspective view of the cooking assembly shown at the top of FIG. 1.
Figures 4, 4A:
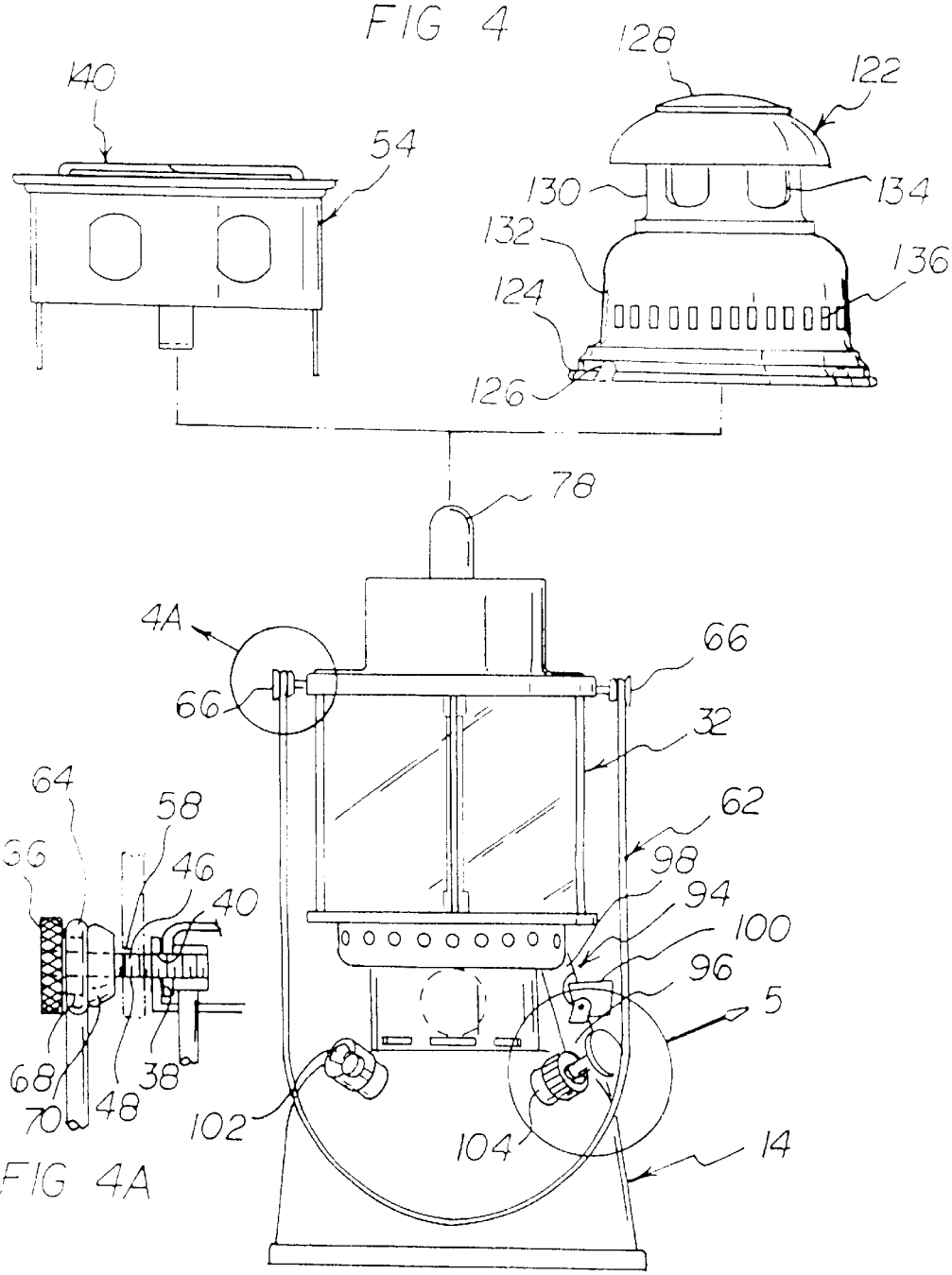
FIG. 4 is a side elevational view of the lantern system shown in FIG. 1 but illustrating the alternate positioning of the dome assembly and the cooking assembly and taken along line 4—4 of FIG. 1.
FIG. 4A is an enlarged showing of the region at Circle 4A of FIG. 4.
Figure 5:
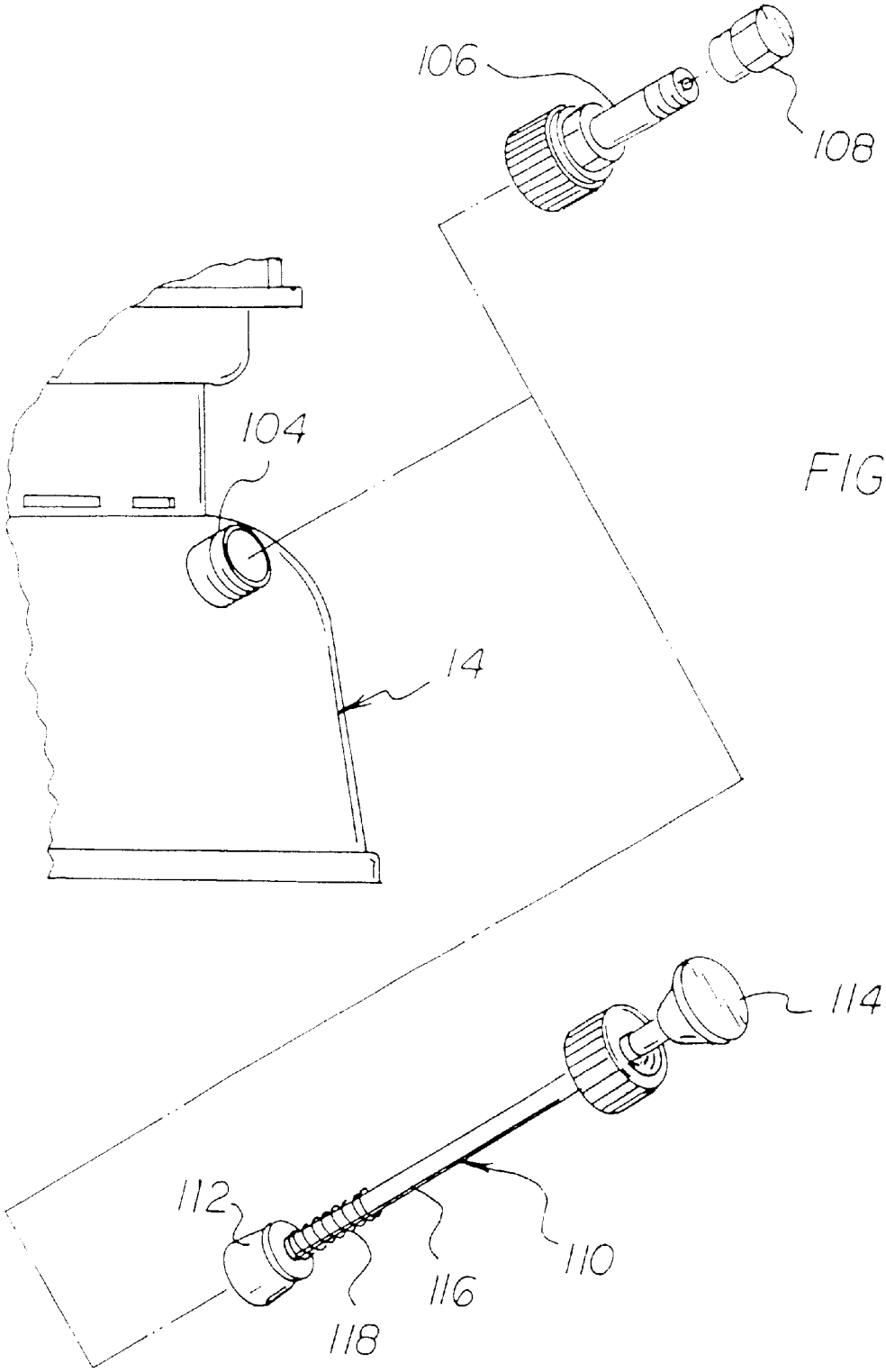
FIG. 5 is an exploded perspective view of the base of the lower assembly shown in FIGS. 1 and 4 as well as alternate pressure generating mechanisms adapted for use with the system of the present invention.

With reference now to the drawings, and in particular to FIG. 1 thereof, the preferred embodiment of the new and improved lantern system embodying the principles and concepts of the present invention and generally designated by the reference numeral 10 will be described.

The present invention, the lantern system 10 is comprised of a plurality of components. Such components in their broadest context include a lower assembly, an upper assembly, an intercasing assembly, a handle assembly, a fluid delivery system, a dome assembly, and a cooking assembly. Such components are individually configured and correlated with respect to each other so as to attain the desired objective.

First provided is a lower assembly 14. The lower assembly includes a base 16 constituting a closed container for the receipt of fuel. The base is formed with a large circular plate 18 at the bottom and a small circular region 20 at the top and with a tapering side wall between the large circular plate and small circular region. The lower assembly also includes a first ring 22 with a horizontal face 24 with four vertical apertures 26. The lower assembly also includes a shaped intermediate component 28 coupling the base and the lower ring.

An upper assembly 32 includes a chimney frame formed of a second ring 34 at its upper extent. Four vertical apertures 36 are provided in the second ring. A vertical wall 38 is provided with diametrically opposed 40 holes. The chimney frame also has four posts 42 with lower ends secured in the apertures of the first ring and with upper ends secured in the apertures of the second ring. Two bolts each have a rectilinear head 46 secured above the upper ends of two of the posts. The bolts have threaded ends 48 extending through the holes of the vertical wall. The upper assembly also includes a cylindrical glass chimney 50 supported on the horizontal face of the first ring and extending upwardly to the second ring radially interior of the posts.

An intercasing assembly 54 is provided. The intercasing assembly is removably secured to the upper surface of the second ring. A vertically extending wall 56 is provided. The vertically extending wall has a lower end formed with two notches 58 straddling the bolts radially interior of the second ring.

A handle assembly 62 is next provided. The handle assembly includes a rigid U-shaped wire with small loops 64 at its ends and two nuts 66 threadedly received in the radially exterior ends of the bolts. Each nut has a radially exterior end with a knurled gripping surface to allow rotation for coupling and uncoupling purposes. Each nut also has an annular recess 68 for pivotally receiving a loop. Each nut also has an abutment shoulder 70 on its radially interior face.

A fluid delivery assembly 74 is provided. The fluid delivery assembly includes a linear pipe 76 secured with respect to the lower assembly and upper assembly. A lower end of the pipe is formed with a valve within the base. An upper end of the pipe is at the upper extent of the upper assembly. The delivery assembly also includes an inverted U-shaped tube 78 secured with respect to the intercasing assembly. The U-shaped tube has an input end 80 operatively associated with the upper end of the linear tube and an output end 82. A mantle support 84 is provided within the chimney to support a mantle 86 for supporting combustion therein for illumination and heating.

Next provided is a control assembly 90. The control assembly includes (a) a valve within the lower assembly and an associated control knob 92 extending outwardly from the intermediate component of the lower assembly to vary the rate of fuel fed from the tank to the mantle, (b) a preheater 94 having a lower end 96 extending into the tank and an upper end 98 extending into the chimney and an central region for supporting a flame with an operator controlled switch 100 pivotable between a lower position to extinguish a flame and an upper position to permit a flame, (c) a gauge 102 having an interior end extending into the tank and an exterior end to display the pressure within the tank, and (d) pressure generating mechanisms coupleable to the tank through a threaded stub 104, adapted for use as an orifice for adding fuel to the tank. Such mechanisms include a valve 106 with an exposed exterior end for coupling to an external source of pressure such as a bicycle pump. The exterior end has a removable cap 108 and, as an alternative pressure generating mechanism includes a finger pump 110 with a leather washer 112 within the tank at the lower end and a reciprocable pusher 114 at the upper end. A rod 116 between the finger pump and pusher effects reciprocation of the leather washer for increasing pressure within the tank. A coil spring 118 around the rod urges the knob upwardly. Locking components are provided to selectively secure the pusher in a downward orientation.

A dome assembly 122 is provided. The dome assembly has an annular vertical wall 124 with two notches 126 positionable to straddle the bolts radially exterior of the second ring when used for illumination purposes. The dome assembly also has a cover 128 and two intermediate vertical walls 130, 132 with openings 134, 136 for ventilation.

Lastly, a cooking assembly 140 is provided. The cooking assembly has an annular vertical wall 142. Ventilation openings 143 are provided through the vertical wall. The vertical wall has an upper circular end 144 formed with a circular horizontal shoulder 146. The vertical wall also has a lower end 148. The lower end has two diametrically opposed legs 150 with inturned horizontal extensions 152 positionable upon the intercasing assembly. The lower end also has two additional legs 154 extending downwardly with notches 156 positionable to straddle the bolts radially exterior of the second ring when used for cooking purposes. The cooking assembly also includes a circular plate 158 with an exterior periphery positionable upon the circular horizontal shoulder. The circular plate also includes four pie shaped openings 160 having cross-shaped support legs 162 with small apertures 164 at the ends of the support legs and rigid rods 166 in a cross-shaped configuration overlying the support legs and with a down turned end 168 secured within the small apertures.

The majority of the components of the lantern and dome, except as is otherwise noted, are preferably fabricated of solid brass with a nickel coating on the exterior surfaces. The cooking assembly, however, is preferably fabricated of stainless steel.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the united states is as follows:

1. A lantern system capable of being selectively utilized as a source of light for illumination purposes and as a source of heat for cooking purposes, comprising, in combination:

a lower assembly including a base with a bottom and a top constituting a closed container for the receipt of fuel formed with a large circular plate of a first diameter at the bottom and a small circular region of a second diameter less than the first diameter at the top with a tapering side wall there between, the lower assembly also including a first ring with a horizontal face with four vertical apertures there through, the lower assembly , also including a shaped intermediate component coupling the top and the bottom of the base;

an upper assembly with an upper extent and a lower extent including a chimney frame formed of a second ring at the upper extent with four vertical apertures there through and a vertical wall with diametrically opposed holes there through, the chimney frame also having four posts with lower ends secured in the apertures of the first ring and with upper ends secured in the apertures of the second ring and with two bolts each having a radially exterior end with a rectilinear head secured above the upper ends of two of the posts, the bolts having threaded ends extending through the holes of the vertical wall, the upper assembly also including a cylindrical glass chimney supported on the horizontal face of the first ring and extending upwardly to the second ring radially interiorly of the posts;

an intercasing assembly removably secured to an upper surface of the second ring with a vertically extending wall with a lower end formed with two notches straddling the bolts radially interiorly of the second ring;

a handle assembly including a rigid U-shaped wire with curved loops at its ends and two nuts threadedly received in the radially exterior ends of the bolts, each nut having a radially exterior end with a knurled gripping surface to allow rotation for coupling and uncoupling purposes, each nut also having an annular recess for pivotally receiving one of the curved loops and an abutment shoulder on its radially interior face;

a fluid delivery assembly including a linear pipe secured with respect to the lower assembly and upper assembly with a lower end within the base and with an upper end at the upper extent of the upper assembly, the delivery assembly also including an inverted U-shaped tube secured with respect to the intercasing assembly and having an input end operatively associated with the upper end of the linear tube and an output end with a mantle support within the chimney supporting a mantle to support combustion therein for illumination and heating;

a control assembly including (a) a valve within the lower assembly and an associated control knob extending outwardly from the intermediate component of the lower assembly to vary the rate of fuel fed from the base to the mantle, (b) a preheater having a lower end extending into the base and an upper end extending into the chimney and an central region for supporting a flame with an operator controlled switch pivotable between a lower position to extinguish a flame and an upper position to permit a flame, (c) a gauge having an interior end extending into the base and an exterior end to display the pressure within the base, and (d) pressure generating mechanisms coupleable to the base through a threaded stub, such mechanisms including a valve with an exposed exterior end for coupling to an external source of pressure, the exterior end having a removable cap and, as an alternative pressure generating mechanism including a finger pump with an upper end and a lower end and with a leather washer within the base at the lower end and a reciprocable pusher at the upper end and a rod there between to effect reciprocation of the leather washer for increasing pressure within the base, the rod having there around a coil spring urging the knob upwardly;

a dome assembly having an annular vertical wall with two notches positionable to straddle the bolts radially exteriorly of the second ring when used for illumination purposes, the dome assembly also having a cover and two intermediate vertical walls with openings for ventilation; and a cooking assembly having an annular vertical wall with ventilation openings there through and with an upper circular end formed with a circular horizontal shoulder and a lower end, the lower end having two diametrically opposed legs with inturned horizontal extensions positionable upon the intercasing assembly and two additional legs extending downwardly with notches positionable to straddle the bolts radially exteriorly of the second ring when used for cooking purposes, the cooking assembly also including a circular plate with an exterior periphery positionable upon the circular horizontal shoulder, the circular plate also including four pie shaped openings leaving cross-shaped support legs with circular apertures at the ends of the support legs and rigid rods in a cross-shaped configuration overlying the support legs and with down turned end secured within the circular apertures.

2. A system capable of being selectively utilized as a source of light for illumination purposes and as a source of heat for cooking purposes, comprising:

a lower assembly including a base constituting a closed container for the receipt of fuel;

an upper assembly including a chimney and bolts;

a handle assembly including a rigid U-shaped wire with curved loops at its ends;

a fluid delivery assembly including a linear pipe secured with regard to the lower assembly and upper assembly with an inverted U-shaped tube secured with respect thereto and having an input end operatively associated with a mantle support within the chimney supporting a mantle to support combustion therein for illumination and heating;

a dome assembly having an annular vertical wall with two notches positionable to straddle the bolts when used for illumination; and a cooking assembly having legs extending downwardly with notches positionable to straddle the bolts.

3. The system as set forth in claim 2 wherein the dome assembly includes a cover and two intermediate vertical walls with ventilation openings.

4. The system as set forth in claim 2 wherein the cooking assembly includes an intercasing assembly with an annular vertical wall with ventilation openings and an upper circular end formed with a circular horizontal shoulder and a lower end, the lower end having two diametrically opposed legs with inturned horizontal extensions positionable upon the intercasing assembly and two additional legs extending downwardly with notches positionable to straddle the bolts radially exteriorly of the second ring when used for cooking purposes, the cooking assembly also including a circular plate with an exterior periphery positionable upon the circular horizontal shoulder, the circular plate also including four pie shaped openings having cross-shaped support legs with circular apertures at the ends of the support legs and rigid rods in a cross-shaped configuration overlying the support legs and with downturned ends secured within the circular apertures.

5. The system as set forth in claim 2 and further including a control assembly including pressure generating mechanisms coupleable to the base through a threaded stub, such mechanisms including a valve with an exposed exterior end for coupling to an external source of pressure, the exterior end having a removable cap and, as an alternative pressure generating mechanism including a finger pump with an upper end and a lower end and with a leather washer within the base at the lower end and a reciprocation pusher at the upper end and a rod there between to effect reciprocation of the leather washer for increasing pressure within the base, the rod having there around a coil spring urging the pusher upwardly.

* * * * *